US009359763B2

(12) United States Patent
Hertz

(10) Patent No.: US 9,359,763 B2
(45) Date of Patent: Jun. 7, 2016

(54) LIGHT-WEIGHT LOAD-BEARING STRUCTURES REINFORCED BY CORE ELEMENTS MADE OF SEGMENTS AND A METHOD OF CASTING SUCH STRUCTURES

(75) Inventor: Kristian Hertz, Brønsøj (DK)

(73) Assignee: Abeo A/S, Frederiksberg (DK)

( * ) Notice: Subject to any disclaimer, the term of this patent is extended or adjusted under 35 U.S.C. 154(b) by 330 days.

(21) Appl. No.: 13/003,631

(22) PCT Filed: Mar. 13, 2009

(86) PCT No.: PCT/EP2009/052987

§ 371 (c)(1),
(2), (4) Date: Feb. 25, 2011

(87) PCT Pub. No.: WO2009/098325

PCT Pub. Date: Aug. 13, 2009

(65) Prior Publication Data

US 2011/0146170 A1 Jun. 23, 2011

Related U.S. Application Data

(60) Provisional application No. 61/080,455, filed on Jul. 14, 2008.

(30) Foreign Application Priority Data

Jul. 14, 2008 (EP) ..... 08160304

(51) Int. Cl.
*E04C 3/22* (2006.01)
*E04C 3/26* (2006.01)
(Continued)

(52) U.S. Cl.
CPC ... *E04C 3/26* (2013.01); *E04C 2/22* (2013.01); *E04C 2/26* (2013.01); *E04C 3/22* (2013.01)

(58) Field of Classification Search
CPC ..... E04C 3/22; E04C 3/26; E04C 2/26; E04C 2/22
USPC ..... 52/600, 601, 604, 568, 426, 562, 565, 52/89
See application file for complete search history.

(56) References Cited

U.S. PATENT DOCUMENTS 129,479 A * 7/1872 Johnson ..... 52/89
918,366 A * 4/1909 Quereau ..... 52/98
(Continued)

FOREIGN PATENT DOCUMENTS

DE 4121113 A1 1/1992
EP 1614823 A2 1/2006
(Continued)

OTHER PUBLICATIONS

Search Report of DK Application No. PA 2013 70305, Jan. 17, 2014.
(Continued)

*Primary Examiner* — Adriana Figueroa
*Assistant Examiner* — Jessie Fonseca
(74) *Attorney, Agent, or Firm* — Saul Ewing LLP; Brian R. Landry, Esq.

(57) ABSTRACT

The invention relates to a light-weight load-bearing structure, reinforced by core elements (2) of a strong material constituting one or more compression or tension zones in the structure to be cast, which core (2) is surrounded by or adjacent to a material of less strength compared to the core (2), where the core (2) is constructed from segments (1) of core elements (2) assembled by means of one or more prestressing elements (4). The invention further relates to a method of casting of light-weight load-bearing structures, reinforced by core elements (2) of a strong material constituting one or more compression or tension zones in the structure to be cast, which core (2) is surrounded by or adjacent to a material of less strength compared to the core (2), where the core (2) is constructed from segments (1) of core elements (2) assembled and hold together by means of one or more prestressing elements (4).

17 Claims, 3 Drawing Sheets

(51) Int. Cl.

| | |
|---|---|
| ***E04C 2/22*** | (2006.01) |
| ***E04C 2/26*** | (2006.01) |

(56) References Cited

U.S. PATENT DOCUMENTS

| | | | | | |
|---|---|---|---|---|---|
| 1,463,841 | A | | 8/1923 | Richman | |
| 2,645,115 | A | | 7/1953 | Abeles | |
| 2,826,157 | A | * | 3/1958 | Vartia | 52/745.08 |
| 3,343,319 | A | * | 9/1967 | Reintjes | 52/249 |
| 4,030,265 | A | * | 6/1977 | Allgood | E04C 3/46 52/223.8 |
| 4,065,932 | A | * | 1/1978 | Oger | 405/153 |
| 4,298,660 | A | * | 11/1981 | Nakagawa | 428/599 |
| 4,745,713 | A | * | 5/1988 | Gotoh | 52/89 |
| 5,797,238 | A | | 8/1998 | Berntsson et al. | |
| 6,832,454 | B1 | * | 12/2004 | Iyer | 52/223.4 |
| 6,877,283 | B2 | * | 4/2005 | Yoshiwara et al. | 52/89 |
| 6,931,797 | B2 | * | 8/2005 | Drew | 52/86 |
| 7,204,058 | B2 | * | 4/2007 | Long | 52/89 |
| 2007/0039283 | A1 | | 2/2007 | Kim et al. | |

FOREIGN PATENT DOCUMENTS

| | | | |
|---|---|---|---|
| FR | 2 555 630 | A1 | 5/1985 |
| GB | 690984 | A | 5/1953 |
| JP | 2000-027335 | A | 1/2000 |
| JP | 2000-282703 | A | 10/2000 |
| JP | 2006-226068 | A | 8/2006 |
| JP | 2013002242 | A | 7/2013 |
| NL | 8 100 138 | | 8/1982 |
| WO | PCT/ISA/210 | | 6/2009 |
| WO | PCT/IPEA/409 | | 10/2010 |

OTHER PUBLICATIONS

International Search Report and Written Opinion of PCT/DK2014/050155, Jul. 24, 2014.

* cited by examiner

LIGHT-WEIGHT LOAD-BEARING STRUCTURES REINFORCED BY CORE ELEMENTS MADE OF SEGMENTS AND A METHOD OF CASTING SUCH STRUCTURES

This application is the U.S. national phase, pursuant to 35 U.S.C. §371, of PCT international application Ser. No. PCT/EP2009/052987, Filed Mar. 13, 2009, designating the United States and published in English on Aug. 13, 2009 as publication WO 2009/098325 A1, which claims priority to European patent application No. 08160304.5, filed Jul. 14, 2008, and U.S. provisional application Ser. No. 61/080,455, filed Jul. 14, 2008. The entire contents of the aforementioned patent applications are incorporated herein by this reference.

The invention relates to light-weight load-bearing structures reinforced by core elements with a core of a strong material constituting one or more compression or tension zones in the structure to be cast, which core is surrounded by or adjacent to a material of less strength compared to the core, where the core is constructed from segments of core elements assembled by means of one or more prestressing elements.

Previously, minimal structures have been applied for large bridges, but they have proved to require many secondary constructions, and it is therefore almost impossible to make real minimal structures for medium sized and small structures as found in buildings and halls.

Different solutions to create concrete structures have been tried over time.

One well-known method is to reinforce concrete by applying rods, wires or profiles of steel to take tension and shear in reinforced concrete structures.

Another method is to combine straight hot rolled steel profiles and heavy concrete into composite structures or to make "sandwich slabs" with steel reinforcement bars or grids in the tension layers or with steel plates as tension or compression layers.

From FR 2878877 A1 is known a mould block where a number of blocks can be cast out with concrete to make a wall and the walls serve as permanent moulds. The blocks can also be placed on a flat thin beam of reinforced concrete supporting the blocks when casting, so that they can form a wall above an opening.

The blocks do not interact with a surrounding stabilizing light material and is not used as reinforcement for a larger structure and do not describe post-tensioned segments of compression or tension zones of any shape to be stabilized by a light surrounding material.

These methods deal with application of reinforcing bars or profiles for the tension or compression zones in elements of reinforced concrete.

However, the profiles are mainly straight or plane and only the wires allow an optimal design of the tension zones in general. None of the methods allows an optimal design of the compression zones.

It has become possible to use high-strength concrete for structural design. However, compressed cross sections of high-strength concrete have to be larger and therefore heavier than needed for the compressive strength in order to be stable.

A compressed cross section such as a column or pillar of a strong material like high-strength concrete will have a tendency to deflect or buckle to the sides when pressure is applied to the ends of the pillar, unless the cross section of the pillar is rather large.

When such a pillar is compressed by applying pressure on the ends, movement of the pillar in a direction crosswise of the longitudinal direction of the pillar will occur. If the crosswise movement of such a pillar increases, it will have impact on the stability of the pillar.

Another drawback to the use of high-strength concrete is the tendency to explosive spalling at temperatures near the critical point for steam 374° C., and several other strong materials cannot be used at high temperatures.

Further, minimal structures are applied for bridges with compression arches made by expensive moulds following the moment curves and to which the load is applied from the bridge deck by tension bars under the arch or by columns above it.

Prestressed concrete structures are applied to for example TT beams for large spans in prefabricated halls for industry and commerce. These beams represent a quite optimal use of heavy reinforced concrete. However, Super Light Structures with concentrated compression and tension zones embedded in light material may improve the performance considerably with regard to dimensioning the structure and the length of the free span of the load-bearing structure.

In some prestressed concrete structures the path of the prestressing cables may follow the variation of the moment load. Here the tension zone is optimized, but the compression zone is not. The entire cross-section is compressed and not cracked, and it therefore contributes to the stiffness counteracting deflections. Still the compression zone is stabilizing itself. In the invention, the stability is provided by a light material in contact with or surrounding the compression zone and further the compression zone is build up as a core element consisting of segments of a material of suitable compressive strength such as a high-strength concrete protected by the light material.

The segments of core elements should be made of a strong material. A suitable material could be extruded high-strength concrete with or without fibre reinforcement for improving the ductility, ordinary concrete, or ceramics, but any other materials can be used as long as the strength is sufficient, and they have sufficient other properties needed for their function in the actual structure. As a single example, if the fire is not a risk or the impact of fire can be reduced sufficiently by the light material, carbon-fibre based materials may be an option for core segments leading to even lighter structures.

Other sorts of concrete can be used as long as the strength is sufficient.

The reason for making prestressed concrete structures is mainly to reduce deflections. This is usually done by providing the structure with prestressed reinforcement as wires or rods, which act with a compression force on the entire concrete cross-section. When the section is subjected to bending, compression is introduced in one side and tension in the opposite. Tension from the bending moment unloads the compression from the pre-stressing instead of giving rise to tensile stresses and formation of cracks in the tension zone, as would happen in a slack reinforced concrete structure. The cross-section is therefore not reduced by cracking and will preserve its maximum flexural stiffness reducing the deflections from variable load. In addition, the prestressing reinforcement can be arranged in a path, where the prestressing force will give rise to a deflection opposite the deflection of the structure for its dead loads, and therefore result in no deflection at all.

One reason why it is not in general possible to prestress structures of soft materials like light-weight concrete is that these materials will creep when prestressing forces are applied giving rise to continuous deflections and loss of prestress.

By means of the invention, it will be possible to create for example prestressed light-weight concrete structures of much larger span-widths than possible with slack reinforced light-weight concrete or with heavy prestressed concrete structures.

Further advantages is that it is possible to create prestressed tensile zones in structures made of soft materials such as light-weight concrete preventing creep, reducing cracking, large deformations of the construction, and protecting reinforcing steel against for example corrosion, impact, and fire.

The invention further provides a new simple possibility of establishing compression zones for super-light structures by applying for example prefabricated pieces of strong material which are prestressed before casting soft material around or adjacent to it.

The invention makes it possible to cast a super-light load-bearing structure with an optimized shape of the compression zone by providing compression arches or prestressed tension zones formed by segments of core elements to be cast into, and interact with a light material.

When constructing a compression zone from core members for example made of a high-strength concrete, it is possible to form elements of prestressed building structures of almost any shape.

Such core elements can be formed in segments of different shapes and in different lengths.

The invention is intended to cover all aspects of shaping the segments of core elements falling between the embodiments mentioned above in such a way that some segments of core elements can be of different shape and/or length and at the same time some of the other segments of core elements can have same shape and/or same length.

It will often be beneficial to reduce loss of prestress and reduce transversal stresses from load application, if the holes or ducts for prestressing elements in the core elements are curved without sharp edges, or the entire segments including the holes or ducts are curved.

Segments are referred to in the description as segments of core elements, which segments can be of any suitable size and shape and to be used according to the invention.

This is obtained by rethinking a load-bearing structure as a strong skeleton included in a soft material, where the skeleton is constructed from segments of core elements of suitable compressive strength such as strong concrete, ceramics or high-strength concrete with or without a fibre reinforcement and applied as one or more compression zones or tension zones. Segments of core elements are provided along one or more compression or tension zones, in a structure to be cast, surrounded partly or fully by concrete of less strength compared to that of the cores.

If a core constructed from segments of core elements is intended to be a compression zone, the prestressing is assessed to be the smallest possible for the core to be stable and self-supporting, until it is cast into a super-light structure, where it can be loaded in compression.

If a core constructed from segments of core elements is intended to be a tension zone, the prestressing is assessed to be sufficiently large for the maximum tension force to be counteracted by unloaded compression of the core segments.

The segments of core elements can include one or more reinforcement zones in form of one or more bores, holes, or grooves running through the segments of core elements.

The bores, holes, or grooves, are in the following referred to as holes since any kind of a channel or the like running inside or along a segment of core element can be used as guide for a prestressing element.

The hole or holes for the prestressing element or elements runs substantially parallel to the outer surface of the segment of core elements.

When assembling elements to a certain shape it is possible to use segments of core elements with different numbers of holes. This can be possible for example if one or more segments of core elements are provided with means for joining the prestressing elements within or adjacent to the core element.

This is achieved according to the invention by having a light-weight load-bearing structure, reinforced by core elements with a core of a strong material constituting one or more compression or tension zones in the structure to be cast, which core is surrounded by or adjacent to a material of less strength compared to the core, where the core is constructed from segments of core elements assembled by means of one or more prestressing elements and where one or more segments of a core element has at least one end different from 90 degrees relative to a longitudinal axis going through the core elements.

To ensure a joining between two segments of core elements where forces are transferred in an appropriate way, one or more segments of a core element can have at least one end at substantially 90 degrees relative to a longitudinal axis going through the core elements.

The ends or at least one end of a segment can comprise one or more substantial plane surfaces.

In another embodiment this is done by one or more segments of a core element being a curved segment.

In a further embodiment one or more segments of a core element is provided with one or more holes for guiding one or more prestressing elements.

To further ensure forces to be transferred properly between the segments of core elements the hole or holes for the prestressing element or elements runs substantially parallel to the outer surface of the segment of core elements.

To be able to create a kind of lattice or mesh the core element can be provided with a number of openings on the side of the core element for connection to ends of other segments of core elements and thereby forms a kind of knot segment.

In another embodiment a knot segment can be made by protruding connections for prestressing elements of core elements at its sides.

In another embodiment structural elements such as deck- or plate elements with embedded pearl-chain reinforcement can be connected by providing prestressing elements through the sides of the embedded segments of core elements or by separate core elements embedded for that purpose.

In another embodiment a segment of a core element forming a knot segment is formed as a "Y" or a cross with a number of arms protruding from the body of the core element, or a number of faces, each arm or face designed for connection to an end surface of a segment of a core element or the connection of another knot segment.

To protect the hole or holes for guiding one or more prestressing elements from wear and to ensure more even distribution of forces while tensioning the core the one or more holes for guiding one or more prestressing elements are provided with a lining.

In an embodiment the one or more holes with or without a lining for guiding one or more prestressing elements are filled with grout.

When hardened the grout will cause a sealing of the holes and allows transfer of forces between prestressing elements and core element. Further, it provides a heat and corrosion protection of the prestressing element in addition to the heat and corrosion protection provided of the joined segments of core elements covered by concrete of less strength compared to that of the core elements.

The grout can act as a kind of lubricant during insertion of prestressing elements.

To be sure that the prestressing element or elements stays in prestressed position the one or more holes for guiding one or more prestressing elements are provided with retaining means for retaining the one or more prestressing element in prestressed condition.

Such retaining means can be any known retaining means such as wedges, nuts or the like.

The above is further achieved by a method where the core is constructed from segments of core elements assembled and held together by means of one or more prestressing elements.

In an embodiment of the method tension is applied to the core elements by applying one or more prestressing elements through one or more holes in the core elements which one or more holes guides the one or more prestressing elements, the one or more holes are filled with grout before or during prestressing the one or more prestressing elements.

In another embodiment of the method tension is applied to the core elements by applying one or more prestressing elements through one or more holes in the core elements which one or more holes guides the one or more prestressing elements, the one or more holes are filled with grout after one or more prestressing elements are prestressed.

By means of self-supporting core elements provided by the invention, scaffolding can even be reduced or avoided.

This is achieved for compression zones and/or tension zones formed by prestressed segments of core elements by providing them with mould parts or mould textiles for casting out the surrounding or adjacent material of less strength compared to the core.

Alternatively, the adjacent stabilising material of less strength may be cast on the core elements before they are assembled by prestressing, so that core element and stabilising material make a prefabricated unit to be assembled with other units or other prefabricated units by prestressing.

Such prefabricated units could for example be wall or shell units or units for frame buildings.

As a special example, it is well known that a large floor area for example for an office landscape can be established by means of floor slab units spanning between beams, which are supported by columns at the sides of the floor area. If the floor slab units are provided with one or more segments of core elements across their primary bearing direction, prestressing of the core elements makes it possible to assemble the floor slab units to constitute a beam carrying the load to the side columns, instead of supporting the slab units on a separate beam.

By the invention it is possible to form compression or tension zones from segments of core elements of strong concrete at a factory or at the construction site, where the larger load-bearing structure is to be produced. At the factory or at the site the strong concrete core member or members are placed in a mould or the mould is alternatively supported by the core, and thereafter the load-bearing structure is produced and cast out with light material whereby the strong concrete core member or members are completely or partly surrounded by light material.

It is also possible to prefabricate units of core elements with light material to be assembled at the construction site or at a factory producing larger substructures.

The invention makes it possible to give the structure an external shape supporting the applications or building structures, so that the load can be applied, and give a possibility for the structure to be included in for example roofs, walls, decks, tunnels, bridges, foundations, ships, barges, off-shore structures or any other structure.

The invention makes it possible to protect the compression or tension zones against mechanical impacts.

The invention makes it possible to protect the compression zones against fire. Fire is especially a problem for high-strength concrete, because the risk of explosive spalling and a number of severe damages have been seen due to spalling of structures made of high-strength concrete. The spalling is a major hindrance for the application of high-strength concrete. The invention may use ordinary porous concrete instead, but high-strength concrete will sometimes be beneficial, and the invention may solve the spalling problem for example by ensuring that the concrete is not heated above a limit near the critical temperature for water 374° C., where spalling problems occur. This can for example be achieved by having the high-strength concrete embedded in a light concrete of a light-weight load-bearingstructure, where the light material provides a heat isolating effect to the core.

If the light materials provides a sufficient protection against fire, or if fire is no problem for the structure, other strong materials for the segments of core elements can also be considered for example carbon fibre reinforced epoxy etc.

Alternatively fire proof materials of sufficiently high strength may be applied such as for example ceramics, brick, stoneware, porcelain, or porous concrete.

Hereby is achieved that the quantity of strong and often heavy materials for compression or tension zones can be minimized, because the light material can contribute:

- to make it possible to give compression and/or tension zones optimal shapes and layouts,
- to stabilise compression zones for deflection and buckling,
- to combine compression zones with other parts incl. tension zones if any,
- to give the structure an external shape supporting the applications,
- to protect compression and tension zones against mechanical impacts, and
- to protect compression and tension zones against fire.

Materials for compression zones are often 3-5 times heavier and 3-10 times stronger than the light materials. The application of the principle therefore makes it possible to create structures, which are 2-4 times lighter than traditional cast structures.

This enables large spans and large distances between columns.

Minimal structures, where the positions of compression and tension zones are optimised in relation to the load, has until now been difficult and often impossible to make, because the function requirements mentioned cannot be fulfilled in practice in particular for small and medium sized structures.

This technology makes minimal structures more applicable for buildings.

This technology makes high-strength concrete and other strong materials more applicable for buildings.

In the following embodiments of the invention will be described with reference to the drawings, where:

Figure 1:
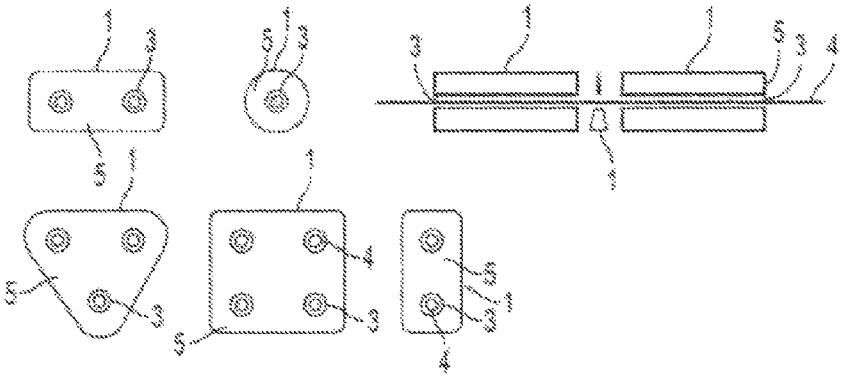
FIG. 1 shows examples of segments of core elements with prestressing elements provided in one or more holes or channels.
Figure 2:
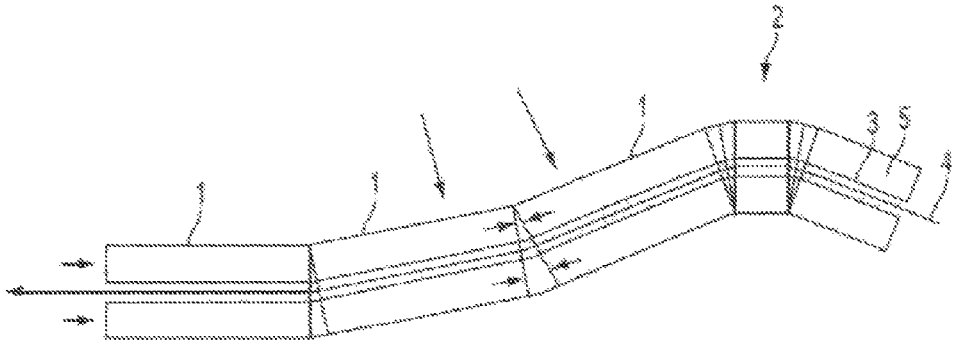
FIG. 2 shows an example of a prestressed curved core tension zone assembled from segments of core elements.
Figure 3:
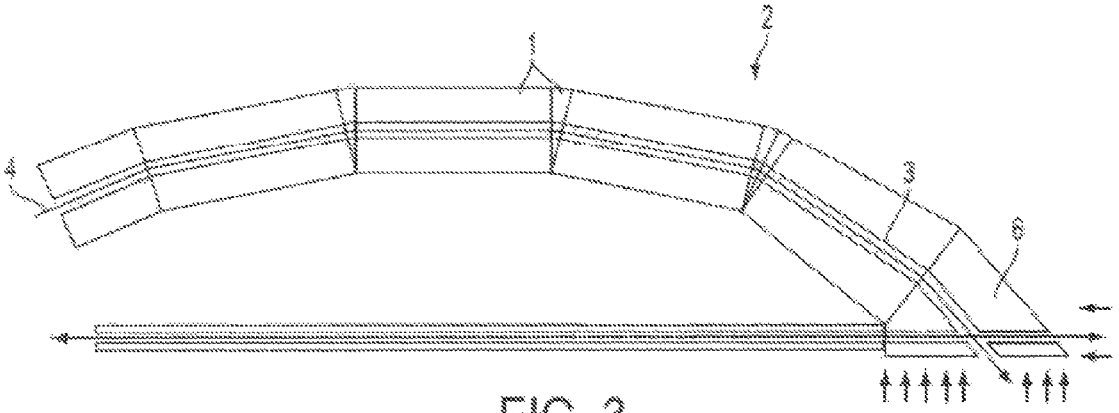
FIG. 3 shows an example of a curved core compression zone and a straight tension zone.
Figure 4:
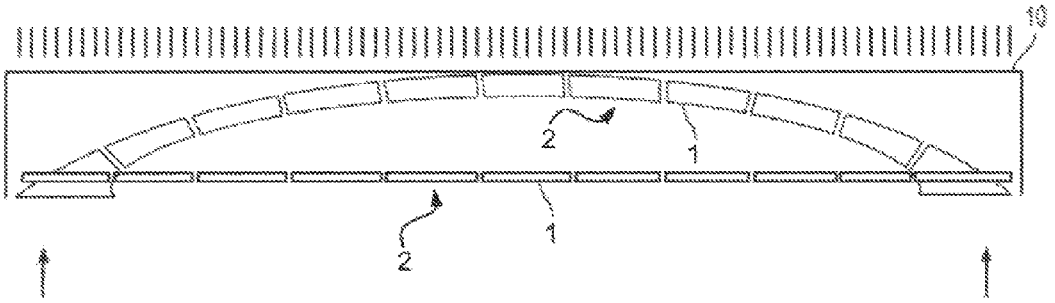
FIG. 4 shows an example of a beam with a curved core compression zone and a straight core tension zone surrounded by a material of less strength 10.
Figure 5:
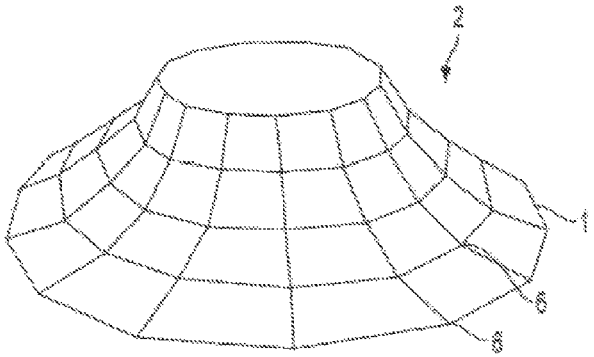
FIG. 5 shows an example of a prestressed core mesh for a shell.

Hereafter different embodiments of the invention are described in detail.

The invention is derived rethinking a load-bearing structure as a strong skeleton included in a soft material, where the skeleton is constructed from segments 1 of core elements 2 of suitable compressive strength such as strong concrete, ceramics or high-strength concrete with or without a fibre reinforcement and applied as one or more compression zones or tension zones. Segments 1 of core elements 2 are provided along one or more compression or tension zones, in a structure to be cast, surrounded partly or fully by concrete of less strength compared to that of the cores.

Segments 1 are referred to in the description as segments 1 of core elements 2, which segments 1 can be of any suitable size and shape and to be used. In the invention stability is provided by a light material in contact with or surrounding the compression zone and further the compression zone is build up as a core element 2 consisting of segments 1 of a material of suitable compressive strength such as a high-strength concrete protected by the light material.

The segments 1 of core elements 2 can include one or more reinforcement zones in form of one or more bores, holes, or grooves 3 running through the segments 1 of core elements 2.

The bores, holes, or grooves 3, are in the following referred to as holes 3 since any kind of a channel or the like running inside or along a segment 1 of a core 2 element can be used as guide for a prestressing element 4.

The hole or holes 3 for the prestressing element or elements 4 runs substantially parallel to the outer surface of the segment 1 of a core element 2.

In an embodiment of the invention, each segment 1 of a core element 2 is designed and shaped in relation to the position in the structure where the segment 1 is to be positioned.

In another embodiment of the invention, the segments 1 of core elements 2 are formed as modular elements. Hereby it is possible to build up a structure of core elements 2 taken from a catalogue. In other words, it is possible to manufacture the segments 1 of core elements 2 in standardised shapes and lengths.

In yet an embodiment the segments 1 of core elements 2 are combined in such a way that it is possible to construct core elements 2 with bends in two or three dimensions. This is achieved by using curved elements or by providing at least one end 5 of a core segment with a plane showing an angle different from 90 degrees to a longitudinal axis in the direction of a normal force acting between the core elements. By combining core segments 1 having ends 5 at substantially 90 degrees with segments 1 having ends 5 formed with a sloping surface or by application of curved segments 1, it is possible to create core elements 2 extending in two or three dimensions.

The ends 5 or at least one end 5 of a segment 1 can comprise one or more substantial plane surfaces.

The length of the segments 1 of core elements 2 can be of standardised lengths, individual lengths, and lengths modified to the building structure.

The same applies to the lengths of the segments 1 of core elements 2 no matter if their ends 5 are sloping or substantially perpendicular to the longitudinal axes of the core elements 2.

In many occasions, it will be most convenient to have the latter in short lengths. This can make it easier to create bends of the core element 2.

It is also possible to have segments 1 of core elements 2 being curved or having sloping ends 5 in different angles. Thereby it is possible to combine for example two segments 1 of core elements 2 of 15 degrees and one segment 1 of a core element 2 of 20 degrees to apply a bend of 50 degrees to the core element 2.

In embodiments where the segments 1 of core elements 2 are provided with more than one hole 3, two adjacent segments 1 are not able to rotate relative to each other due to the number of prestressing elements 4 running through the holes 3.

In an embodiment where only one hole 3 is present in the segments 1 of core elements 2, it may be appropriate to provide a locking member (not shown) preventing two adjacent segments 1 from rotating in relation to each other.

Such a locking member can be a hollow in form of a recess, groove or the like formed in one end of the segment 1 manufactured to interact with a corresponding elevation in the adjacent end of the segment 1 next in line or with a separate interlocking member in-between the two members when forming the skeleton of core elements 2.

By having an elevation fitting into the above hollow of the adjacent surfaces of two joining segments 1 of core elements 2, the segments 2 are prevented from rotation in axial direction in relation to each other, if this is needed. In addition, the position of the holes of two adjacent segments 1 may be secured to be in line.

In an embodiment, a layer of a kind of mortar, sealant or the like may be cast out between segments 1 of core elements 2 before prestressing. This mortar or sealant may compensate for irregular end-surfaces 5 of segments 1 to be joined. The mortar or sealant may in some cases fill out holes of adjacent segments 1 providing a lock.

In an embodiment of a light-weight load-bearing structure one or more compression zones with segments 1 of core elements 2 of for example strong concrete are combined with reinforcement in tension zones or with segments 1 of core elements 2 of for example strong concrete, where the core elements 2 takes tension by unloading prestressed compression.

In another embodiment of a light-weight load-bearing structure, only the tension zones are formed as core elements 2 of prestressed segments 1, where the core elements 2 takes tension by unloading prestressed compression.

Further reinforcement in tension zones or for obtaining prestressing of segments 1 of core elements 2 can be provided by suitable parts such as ropes, wires, plates, meshes, fabrics, rods or bars of suitable materials such as steel, carbon fibres, nanotubes, nanofibres, glass, polypropylene fibres, aramide fibres, or other products of plastic, metals or organic fibres.

The holes 3 in the segments 1 of core elements 2, in which holes 3 the prestressing elements 4 are intended to be placed can be provided with a kind of lining (not shown) to reduce friction between the prestressing element 4 and segment 1. Especially when inserting and tensioning of the prestressing element 4 in the lining, the prestressing element 4 will slide through the holes 3 and at the same time undue forces acting during tensioning of the prestressing elements 4 are reduced or even prevented.

Further in an embodiment it is possible to fill the holes 3 in the core elements 2 with a kind of grout after positioning and prestressing the prestressing elements 4.

Grouting is performed for example by injecting grout in the holes 3 of the core elements 2 so that the grout will surround the prestressing elements 4 positioned in the holes 3.

The grout will then cause an attachment between the prestressing element 4 and the inner surface or an inner lining of the hole 3.

Hereby the hardened grout will cause a sealing of the holes 3 further providing a heat and corrosion protection of the prestressing element 4 in addition to the heat and corrosion protection provided of the joined segments 1 of core elements 2 covered by concrete of less strength compared to that of the core elements 2

A grout will also allow forces to be transferred between the prestressing element 4 and the segments 1 of core elements 2.

In other embodiments without grouting, unbonded tendons could be used.

Another way to secure the segments 1 from displacement relative to each other and relative to the centre axis is to have a tube lining in one or more of the holes 3 in the segments 1 of core elements 2, which lining protrudes a distance out from the surface of one end portion of the segments 1. In the correspondent opposite end of the next segment 1 in line the lining is positioned a distance within the segment 1, which distance corresponds to the protruding distance of the lining from the preceding segment 1 of core elements 2.

In an embodiment, where only one hole 3 is present in the segments 1 of core elements 2, mutual means for preventing rotation around the longitudinal axis of the segments 1 of core elements 2 may be provided. Such means can for example be corresponding grooves and tongues, or notches and ridges or half cylindrical shells protruding from the ends of the linings, together forming a tube, or corresponding shapes or cuts of the ends of lining tubes.

It is also possible to form the segments 1 of core elements 2 with convex and/or concave end portions.

To be able to fix the segments 1 of core elements 2 in a given position to eachother, the concave and convex end portions can be provided with grooves and/or tongues or ridges or intersecting elements. The grooves and/or ridges may beformed in concentric circles, or parts of concentric circles, or radial lines, or in any other suitable pattern.

When the prestressing element 4 is tensioned, the two adjacent segments 1 of core elements 2 are pressed together and thereby fixed in position.

When having substantially flat end surfaces 5 on the segments 1 of core elements 2, it is possible to apply a higher load to the core elements 2 than if the ends 5 of the segments 1 of the core elements 2 have other shapes.

To be able to transfer large forces at joints and bearings, it is possible to form a greater cross section near the ends of the core elements 2 by application of segments 1 of core elements 2 with a conical shape or with any other variation of cross section.

Likewise, cross section variations can also be applied in order to counteract variations of load along a core element 2 for example due to the weight for the structure itself in an arch.

In a further embodiment, more core elements 2 in compression, in tension or combinations of these are joined with or without application of special knot segments 6 to form a structure of more dimensions such as for example a shell, a hanging structure, a plate, a slab, a lattice, a girder, a tube, a box etc.

Figure 6A:
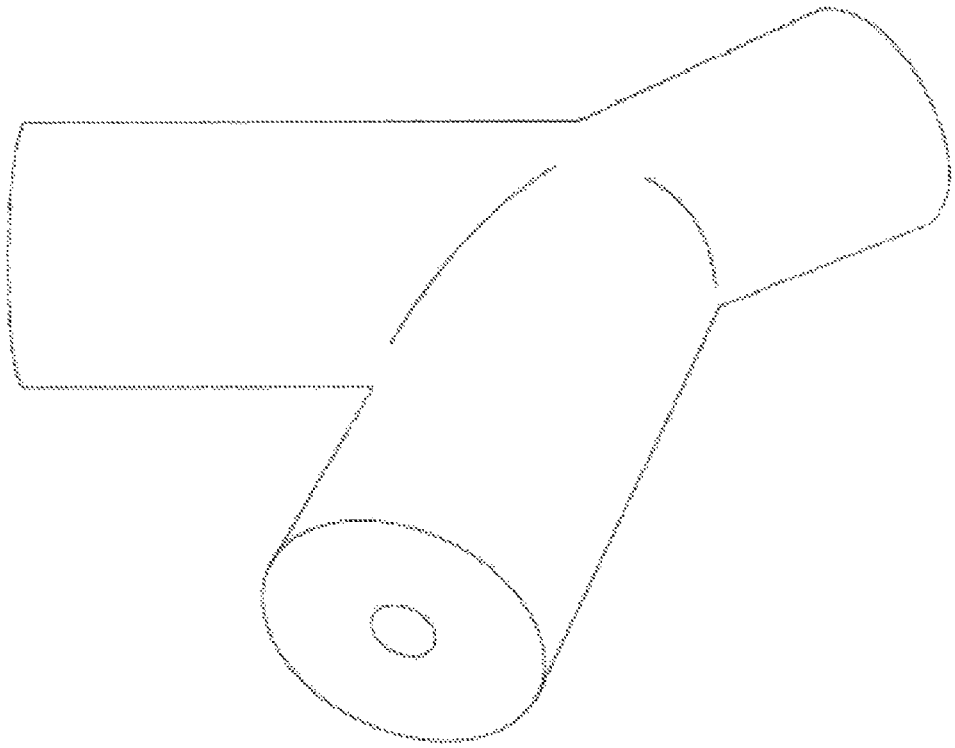
FIG. 6A depicts a knot segment 6*a* formed as a "Y"
Figure 6B:
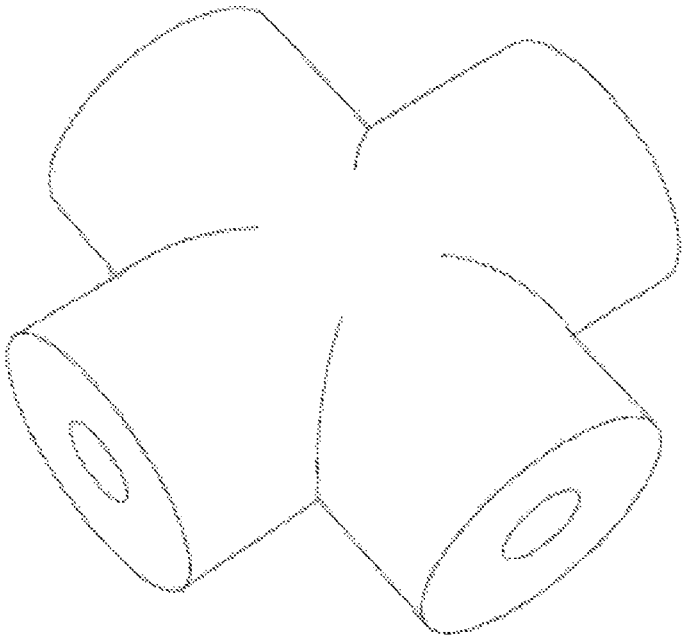
FIG. 6B depicts a knot segment 6*b* formed as a cross.

As depicted in FIG. 6A and 6B, the segments 1 of core elements 2 forming the knot segments can be formed as a "Y" 6*a* or a cross 6*b* with a number of arms protruding from the body of the core element 2, each arm designed for connection to an end surface 5 of a segment 1 of a core element 2 or the connection of another knot segment 6.

Some segments 1 of core elements 2 can be provided with a number of openings(not shown) on the sides of the core element 2. The openings are designed for connection to an end surface 5 of a segment 1 of a core element 2 and the sides near to the openings or an end surface 5 of a core element 2 are adapted to be connected to each other either by providing a plane surface on the side close to the openings, by having plane sides in connection to the openings or by having curved ends 5 on the joining segments 1 of core elements 2.

Hereby it is possible to combine one or more compression and/or one or more tension zones to form a lattice, or mesh, or any other load-bearing part of a structural member.

It is further possible to join compression or tension zones with load-bearing zones of other structural members.

In another embodiment, one or more compression or tension zones are provided with a cross section, which cross section increases towards points where forces are exchanged with other compression or tension zones.

Hereby is achieved an expedient embodiment of a core 2 forming the compression or tension zone and expedient transitions between compression or tension zones formed by segments 1 of core elements 2 reducing the contact stresses or stresses in knot segments 6, or improving anchorage, or force interaction between such zones in different structural members or parts being joined.

In further an embodiment one or more compression zones formed by segments 1 of core elements 2 are provided with a cross section increasing towards at least one end 5.

In a further embodiment the increased cross sections of the compression or tension zones formed by segments 1 of core elements 2, for example at the ends 5, are joined in joints or by joining segments 1.

A core element 2 formed by segments 1 of core elements 2 can be placed in a mould for a load-bearing structure, or in some embodiments a self supporting core element 2 may support a mould around or adjacent to it.

A core element 2 formed by segments 1 of core elements 2 can be placed where it is desired to concentrate compression, for example in a compression arch.

A core of segments 1 of core elements 2 of a strong material, for example a strong concrete or a self-compacting high-strength concrete, is formed corresponding to the compression or tension zone in a building structure. Then a mould is thereafter cast out around the core with a light material, which for example can be light aggregate concrete.

Strong concrete is any concrete stronger than the light material and it can be obtained in several different ways and the invention is not limited to a single method of obtaining strong concrete. As an example, a concrete of high strength may be applied, and it could be obtained by adding fine-grained particles to the concrete. Further, it is possible to apply additives to the strong concrete and/or to the light material, among which super-plastifying additives, fibres of steel plastic or any other material, or materials may be used to obtain high-strength properties and/or improved workability such as self-compacting properties or ductility.

Segments 1 of core elements 2 can also be made of any other material with sufficient strength and material properties required for the actual construction, which in some cases might be for example glass or carbon fibre reinforced epoxy, ceramics, brick, stoneware, porcelain, structural glass, steel etc.

By forming compression or tension zones from segments 1 of core elements 2, it is possible to give the compression or tension zones optimal shapes and layouts following the actual shape of force trajectories, and by applying prestressing elements 4 it is possible to further stabilise compression and tension zones for deflection and buckling prior to casting, so that they do not need to be stabilised in the mould or to be larger than necessary for the cross section to resist the load without being increased in order to ensure the flexural stiffness.

By means of self-supporting core elements 2, scaffolding can even be reduced or avoided.

Stability of the core elements 2 is further achieved by the invention by a method of casting of lightweight load-bearing structures with an optimized compression zone where the core is constructed from segments 1 of core elements 2 and stabilized by a light material such as a lightweight concrete.

In another embodiment of the invention the compression or tension zones represented by the cores 2 of strong materials can be provided with a larger cross section at the points joining other compression or tension zones or establishing joints or segments.

In combination with one or more of the aforementioned embodiments, it is possible to add different elements to the materials for example to a concrete to obtain a suitable texture for casting or to obtain a kind of tensile reinforcement or to improve ductility.

Such elements can be ropes, wires, plates, meshes, fibres, fabrics, rods or bars of suitable materials such as steel, carbon fibres, nano tubes, nano fibres, stone wool fibres, glass, polypropylene fibres, aramide fibres, or other products of plastic, metals or organic fibres.

In an embodiment where the core elements 2 are cast out in such a way that they are visible from the outside through or at the surface of the material of less strength compared to the core 2, which material surrounds or is adjacent to the core 2. It is possible to achieve a kind of visible framing looking a bit like a "timber framing", thereby be able to provide visible arches in colours (for example shades of red, brown or black) in the building structure, and the adjacent stabilizing material of less strength compared to the core 2 can be in the colours of for example shades of white, grey or light brown. Hereby it is possible to follow the static behaviour and the static construction in the building structure.

It is obvious that other suitable materials can be used and the invention is not limited to the use of the elements mentioned above.

Figuratively speaking, it is possible to compare the invention to a human or an animal body, where the strong material of a compression zone provides a kind of spinal column compared to the spine of humans or animals, and the lightweight load-bearing structure and the tension reinforcement if any is the muscles and sinews holding the "spine" in place providing an optimized and elegant building structure. Further, a tensioning member within or along the "spine" may prevent the segments of the spine to deflect and it may enable it to take tension as unloaded compression without separating the segments of the spine.

The invention claimed is:

1. A light-weight load-bearing structure, comprising:

one or more core elements each constructed from a plurality of segments of high-strength concrete material and constituting one or more compression or tension zones in the structure, and a lightweight concrete material of less strength compared to the one or more core elements surrounding or adjacent to the one or more core elements, wherein the segments of the one or more core elements are assembled by one or more prestressing elements such that at least one of the plurality of segments have at least one end angled different from 90 degrees relative to a longitudinal axis through the segments.

2. The light-weight load-bearing structure according to claim 1, characterized in that at least one of the segments is a curved segment.

3. The light-weight load-bearing structure according to claim 1, characterized in that at least one of the segments has at least one hole for guiding the one or more prestressing elements.

4. The light-weight load-bearing structure according to claim 3, characterized in that the at least one hole for the at least one or more prestressing elements runs substantially parallel to an outer surface of the at least one of the segments.

5. The light-weight load-bearing structure according to claim 3, wherein the at least one hole for guiding the one or more prestressing elements is provided with a lining.

6. The light-weight load-bearing structure according to claim 3, wherein the at least one hole for guiding the one or more prestressing elements is filled with grout.

7. The light-weight load-bearing structure according to claim 3, wherein the at least one hole for guiding the one or more prestressing elements is provided with retaining means for retaining the one or more prestressing elements in prestressed condition.

8. The light-weight load-bearing structure according to claim 1, characterized in that at least one of the segments constitute a knot segment having a geometry selected from the group consisting of: a "Y", a cross with a number of arms protruding from said at least one of the segments, and a number of faces, wherein each arm or face is designed for connection to an end surface of another segment of another core element or connection of another knot segment.

9. The light-weight load-bearing structure according to claim 1, characterized in that one or more of the segments have one or more openings or connections for prestressing elements on a side surface for connection to ends of other segments of core elements.

10. The light-weight load-bearing structure according to claim 1, wherein the plurality of segments in each of the one or more core elements are assembled in direct contact with adjacent segments.

11. The light-weight load-bearing structure according to claim 1, wherein the one or more core elements are encased by the lightweight concrete material.

12. The light-weight load-bearing structure according to claim 1, wherein the plurality of segments collectively have a plurality of different shapes.

13. The light-weight load-bearing structure according to claim 1, wherein the plurality of segments collectively have a plurality of different lengths.

14. The light-weight load-bearing structure according to claim 1, wherein at least one of the core elements has a three-dimensional path.

15. The light-weight load-bearing structure according to claim 1, wherein the high-strength concrete includes one or more selected from the group consisting of: fine-grained particles, additives, super-plastifying additives, fibers, steel fibers, and plastic fibers.

16. The light-weight load-bearing structure according to claim 1, wherein the lightweight concrete material is cast to surround or lie adjacent to the one or more core elements before or after the one or more core elements are assembled by prestressing.

17. The light-weight load-bearing structure according to claim 2, wherein the lightweight concrete material is cast to surround or lie adjacent to the one or more core elements before or after the one or more core elements are assembled by prestressing.

* * * * *